United States Patent [19]

Hashimoto et al.

[11] Patent Number: 4,627,093

[45] Date of Patent: Dec. 2, 1986

[54] ONE-CHIP LSI SPEECH SYNTHESIZER

[75] Inventors: Shintaro Hashimoto, Ikoma; Hideo Yoshida, Kashihara, both of Japan

[73] Assignee: Sharp Kabushiki Kaisha, Osaka, Japan

[21] Appl. No.: 220,918

[22] Filed: Dec. 29, 1980

[30] Foreign Application Priority Data

Dec. 27, 1979 [JP] Japan ..... 54-170857

[51] Int. Cl.[4] ..... G10L 5/00

[52] U.S. Cl. ..... 381/51

[58] Field of Search ..... 179/1.5 M; 364/710, 364/513, 513.5; 381/51-53

[56] References Cited

U.S. PATENT DOCUMENTS 4,179,584 12/1979 Tanimoto et al. ..... 179/1.5 M

OTHER PUBLICATIONS

Wigfall, "Microprocessor Based Voice Synthesizer", Digital Design, Mar. 1977, pp. 15, 16.

Myers, "Advances in Computer Architecture", John Wiley, p. 55.

Caldwell, "Programmable Synthesis . . . ", IEEE Conf. Acoustics, 1980, pp. 868-871.

*Primary Examiner*—E. S. Matt Kemeny

*Attorney, Agent, or Firm*—Birch, Stewart, Kolasch and Birch

[57] ABSTRACT

There is disclosed a one-chip speech synthesizer capable of providing synthesized human voices through a new and effective concept of LSI architecture. The synthesizer may execute all of the steps necessary for processing of sample data and enhances the processing speed through a new memory architecture by constructing the one-word length of a control memory (control ROM) longer than the one-word length of a data memory (data ROM). The synthesizer reproduces audible synthesized sounds merely by an added amplifier outside the one-chip LSI semiconductor device without the need to provide a digital-to-analog converter. The LSI device may be used with an expandable external memory as an extension of the data memory (data ROM) whenever a large number of words are to be processed.

3 Claims, 7 Drawing Figures

ONE-CHIP LSI SPEECH SYNTHESIZER

BACKGROUND OF THE INVENTION

This invention relates to a speech synthesizer and more particularly to a monolithic semiconductor device for providing a systematic control in synthesizing sound information.

The past and present-day investigations of synthesis of speech are significantly different in that the former is aimed at studying what is the best hardware to synthesize human voices and the latter is devoted toward the development of a new and unique program suitable to synthesis of speech, that is, a software for controlling the voice synthesizer.

In the past years, the synthesizing of speech was achieved mainly by a hardware architecture especially comprising a hard block including a storage memory for storing a number of sequences of synthesis and an instruction decoder (hereinafter referred to as "hard block A"), a hard block including a family of address registers, a family of counters for counting the number of data, the basic counts of voiced and voiceless sounds and registers for temporarily storing phonemic data and amplitude data (hereinafter referred to as "hard block B") and a hard structure including a multiplier for executing multiplications on the phonemic data and the amplitude data (hereinafter referred to as "hard block C"). Provided that the procedure of speech synthesis is implemented with such time-honored basic hard achitecture, the counters should comprise different sorts of logically wired flip flops with added increment and decrement functions, for example. A random logic structure including random connections of such logic elements as gates, flip flops and counters, however, has the difficulty that the area required for those elements is limited and the area required for wiring is enlarged and all of those elements are not easily implemented in an economical size. It is therefore not possible to put the speech synthesizer on a one-chip LSI semiconductor device. Furthermore, an increase in chip size causes an exponential increase in cost.

In an attempt to solve the above discussed problems, the inventors have discovered that the hard block A in the above synthesizer architecture may be replaced with a read only memory (ROM) and the hard block B having the functions of addressing, counting and temporarily storing the phonemic data be replaced with a read and write memory (RAM). In addition, they have recognized that the multiplier in the hard block C may be eliminated by loading the results of multiplications into part of a sound data memory ROM as a storing table. As a result, the inventors have achieved one-chip LSI implementation of the speech synthesizer. This success has the advantages of increasing the effective area of those elements, integration density and the number of the elements per unit area.

The speed of processing data for speech synthesis depends upon sampling frequency. In order to attain real-time processing, there is the troublesome problem of how to process sample data within a sampling interval. For example, the data should be processed with 125 usec and 62.5 usec when the sampling frequency is 8 KHz and 16 KHz, respectively. The length of the data which can be processed within 62.5 usec amounts to no more than 8 steps, making it difficult to execute a sequence or process within such 8 steps. The inventors sought a new method by which to increase processing speed even when the operating frequency (sampling frequency) is low. As a consequence, the inventors discovered that a new effective solution lies with determination of the word length of a ROM performing the functions of the hard block B. In other words, increasing the seeming processing speed can be achieved by choosing the word length of the ROM considerably longer than that of the data ROM (for example, the former is 18 bits long and the latter is 8 bits, 4K bytes). The word length of 18 bits makes it possible to execute abouts 500 steps of operation within. Assuming that the one-word length of the ROM is 18 bits, 5 bits are assigned to instruction bits, 5 bits are assigned to RAM address bits and the remaining 8 bits are assigned to operand and next address bits. With such an arrangement, it becomes possible to execute a number of operations at one time. Thus, it becomes possible to provide access to the RAM at high speed in response to the output of the control ROM. As a rule, in order to enhance the processing speed of an LSI chip, the ON resistances of the elements should be as low as possible and supply voltages should be as high as possible to accelerate charge migration. These requirements inevitably result in a substantial increase in chip size as well as a significant deterioration in yield.

The method of the present invention by which the one-word length of the the ROM is selected to be substantially longer than that of the data ROM may be named "horizontal instruction method", whereas the prior art ROM architecture (say, 8 bits) may be named "vertical instruction method."

OBJECTS AND SUMMARY OF THE INVENTION

Accordingly, it is an object of the present invention to provide a speech synthesizer which may be implemented with a monolithic semiconductor device.

It is another object of the present invention to provide a speech synthesizer which may be implemented with a one-chip LSI semiconductor device.

It is still another object of the present invention to provide a device which may execute all of the steps necessary for processing of sample data and enhance the processing speed through a highly efficient memory architecture by constructing the one-word length of a control memory (control ROM) longer than the one-word length of a data memory (data ROM).

It is another object of the present invention to provide a device which may reproduce audible synthesized sounds merely by an added amplifier outside a one-chip LSI semiconductor device without the need to provide a digital-to-analog converter indispensable to pulse width modulation.

It is another object of the present invention to provide a device which has an expandable external memory as an extension of the data memory (data ROM) whenever a great number of words are to be processed. In other words, basic words are stored within the data memory and special words peculiar to specific utilizing equipment are stored in an externally connected expansion memory. A control memory is available as it is when the expansion memory is in use.

It is still another object of the present invention to provide a speech synthesizer device having an essential part thereof incorporated into a one-chip LSI device and capable of reproducing sounds indicative of words previously stored in the synthesizer under a certain condition and, when the synthesizer is controlled by a microprocessor, capable of reproducing the results of, for example, calculations or timekeeping information derived from the microprocessor.

BRIEF DESCRIPTION OF THE DRAWINGS

For a more complete understanding of the present invention and for further objects and advantages therof, reference is now made to the following description taken in conjunction with the accompanying drawings, in which.

DETAILED DESCRIPTION OF THE INVENTION

Figure 1:
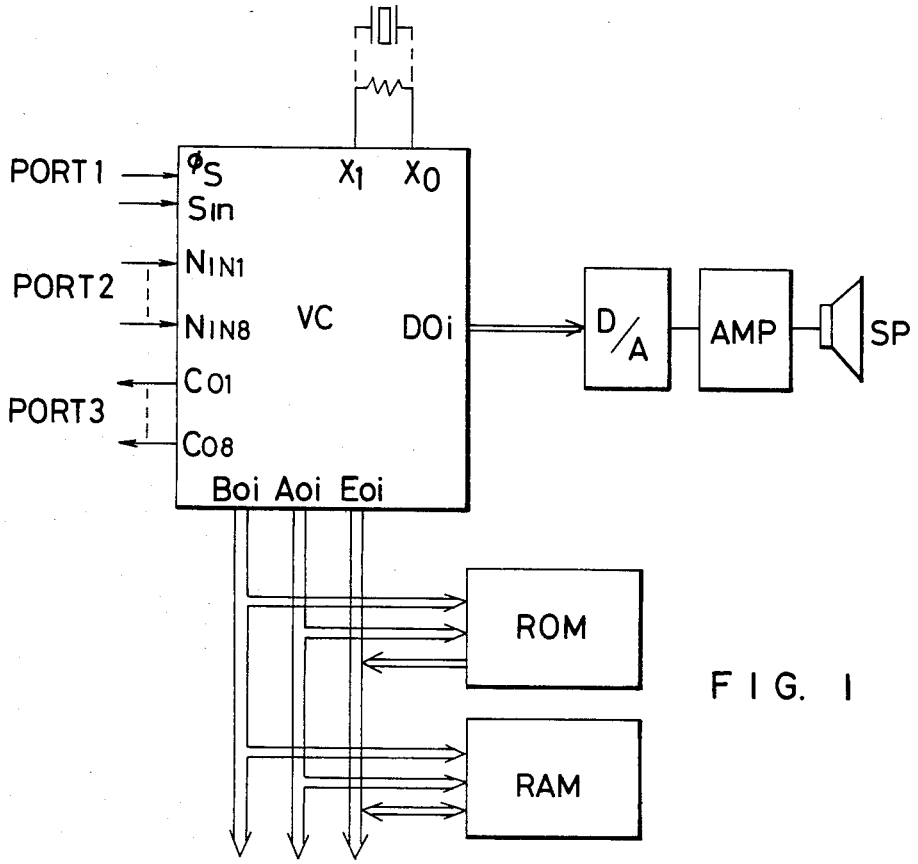
FIG. 1 is a diagram for explanation of the principle of a speech synthesizer according to the present invention.

Referring now to FIG. 1, there is illustrated a speech synthesizer control VC which is implemented with a one-chip LSI semiconductor device having a plurality of external terminals. Terminals $X_I$ and $X_O$ are connected to a quartz oscillator or a resistor for exciting a built-in clock generator in the interior of VC. Port 1 is used to introduce serially data (for example, 8 bit data). The data are applied to terminal $S_{IN}$ and data latch clock pulses are applied to terminal $\phi_S$. When the data are 8 bits long, data are applied to the input terminal $S_{IN}$ eight times. The signals are supplied to $\phi_S$ to maintain the introduction of such bit data in a predetermined timed relationship.

Port 2 is a multi-purpose input port for introduction of 8 bit data or control signals from an external LSI device (typically, CPU) or the like. Port 3 is a multi-purpose 8-bit output port from which 8-bit data and control signals are delivered to the external LSI device (CPU) or the like. An address bus $AO_i$, combined with another bus $BO_i$, form a 16-bit bus which leads address data to an external expansion memory.

8-bit data bus $EO_i$ which is common to inputs and outputs is used to supply the data to the expansion memories (ROM and RAM) and to receive the data from these memories. It is well known that the above-mentioned ROM is a read only memory and the RAM is a read and write memory. An audible output port $DO_i$ is to supply 6-bit digital outputs and 2-bit pulse width modulated (PWM) outputs. In other words, digital sound information from the speech synthesizer control VC is outputted through pulse width modulation. When the port $DO_i$ is used to provide the sound outputs, these outputs are converted into analog sound information via a lowpass filter. There is further provided a digital-to-analog converter D/A, an amplifier AMP and a loud speaker SP.

In the case of the pulse width modulated (PWM) outputs, the output terminals are an additional 2-bit long and provide signals of opposite polarities therefrom. Therefore, the polarity of of the output signals is optionally selectable without phase reversal by an external sound amplifier. It is to be understood that the digital-to-analog converter is unnecessary for the pulse width modulated outputs.

As an alternative, when the 6-bit digital signals (without the 2-bit PWM terminals) are used as the audible outputs, the digital-to-analog converter D/A converts these digital signals into corresponding analog signals, thus providing the audible outputs. In the case where the digital signals and the pulse width modulated signals are both available in the speech synthesizer, there is the possibility to properly use externally connected circuits, parts and quality of sounds depending on the intended use of the speech synthesizer.

Figure 2:
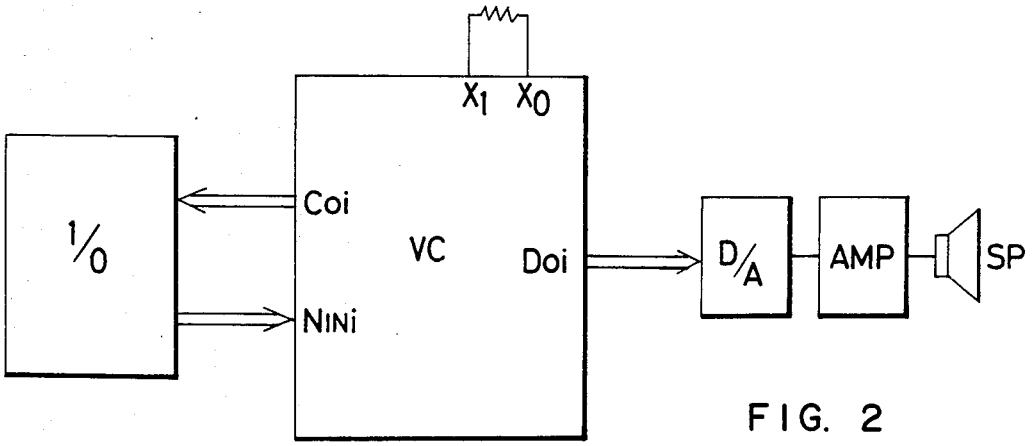
FIGS. 2 and 3 are schematic block diagrams of an embodiment of the present invention.
Figure 3:
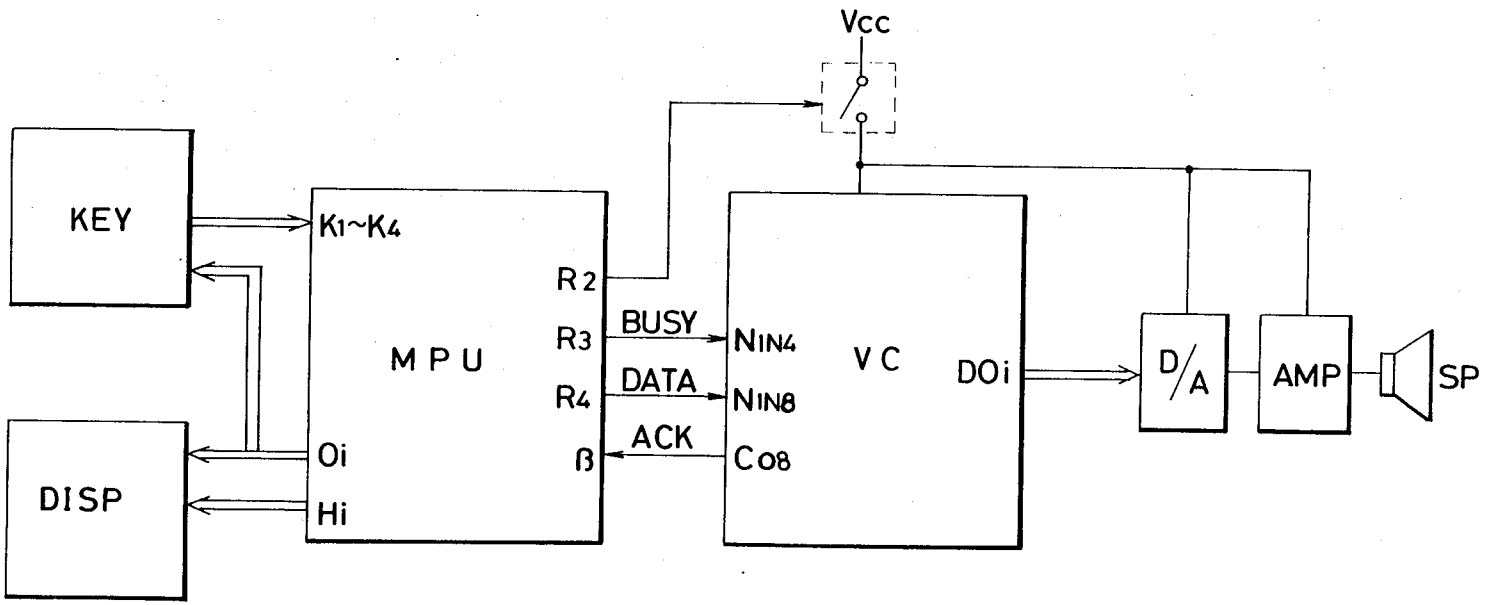

With reference to FIGS. 2 and 3 illustrating an embodiment of the present invention, the speech synthesizer includes an input/output I/O which comprises a well-known keyboard and a display such as a liquid crystal display panel. For example, strobe signals are delivered from $CO_1$–$CO_4$ of the output port $CO_i$ and key inputs are introduced via a matrix in combination with the input port $N_{INi}$. A combination of signals from $CO_1$–$CO_4$ and $CO_5$–$CO_8$ enables the display. Upon actuation of a particular key, corresponding one or ones of lamps in the display are energized. This function is useful with relatively small utilizing equipment where all that is necessary is to provide synthesized sounds indicative of preselected words.

FIG. 3 is a block diagram of a speech synthesizer embodying the present invention which is connected to a microprocessor. This microprocessor is labeled MPU with terminals $K_1$–$K_4$ connected to the keyboard KEY. An output port $O_i$ supplies the strobe signals to the keyboard KEY and segment enabling signals to the display DISP. Moreover, an output port $H_i$ provides a common signal for the display DISP.

These components the microprocessor MPU, the keyboard KEY and the display DISP may achieve the functions of an electronic calculator and, when combined with the speech synthesizer embodying the present invention, provide audible synthesized outputs indicative of the introduced key signals or the results of calculations.

More particularly, an enabling voltage is supplied from a terminal $R_2$ of the microprocessor MPU to the speech synthesizer control VC, the digital-to-analog converter D/A and the amplifier AMP. Then, the microprocessor MPU delivers the audio data to be outputted in the form of synthesized sounds by means of the speech synthesizer control VC. These data are word codes stored within a memory. For example, when the delivering of an audible output indicative of an instruction (X: multiply) is desirable, the microprocessor MPU feeds a code indicative of "multiply" to the control VC.

The data are outputted in a serial fashion from a terminal $R_4$ of the processor MPU to $N_{IN8}$ of the input port $N_{INi}$ of the control VC. To maintain transmission of the data in a proper timed relationship, a busy signal is supplied from a terminal $R_3$ of the microprocessor MPU to a terminal $N_{IN4}$ of the control VC and an acknowledge (ACK) signal is fed from the terminal $CO_8$ of the output port $CO_i$ of the control VC to a terminal of the microprocessor MPU. Through exchange of the BUSY signal and ACK signal data transmission is executed in a well-known manner.

In the following, a logic "1" signal is denoted by "1" and a logic "0" signal by "0." If the speech synthesizer control VC is powered on, it is forced into its initial state which is ready for the ACK signal at $CO_8$ of the output port $CO_i$ and the busy signal to supplied from the microprocessor MPU to $N_{INi}$ of the input port $N_{INi}$ to rise to "1." In response to the "1" busy signal the control VC receives the data applied to $N_{IN8}$, lowering $CO_8$ and the ACK signal to "0." Upon the development of the "0" busy signal the control VC increases the level of the ACK signal to "1" indicating that it is ready to receive the next succeeding data. In response to the ACK signal assuming "1" level, the processor MPU increases the level of the busy signal to "1" and supplies the second bit data to $N_{IN8}$ of the control VC. Through repeated execution of the above described procedure the entire 8-bit word codes are serially transferred to the control VC. The speech synthesizer VC places the word codes into a desired region of the RAM and executes instructions from the control memory depending on information contained in the audio data memory, thus synthesizing sounds corresponding to the successive codes (cf. FIG. 4).

Figure 4:
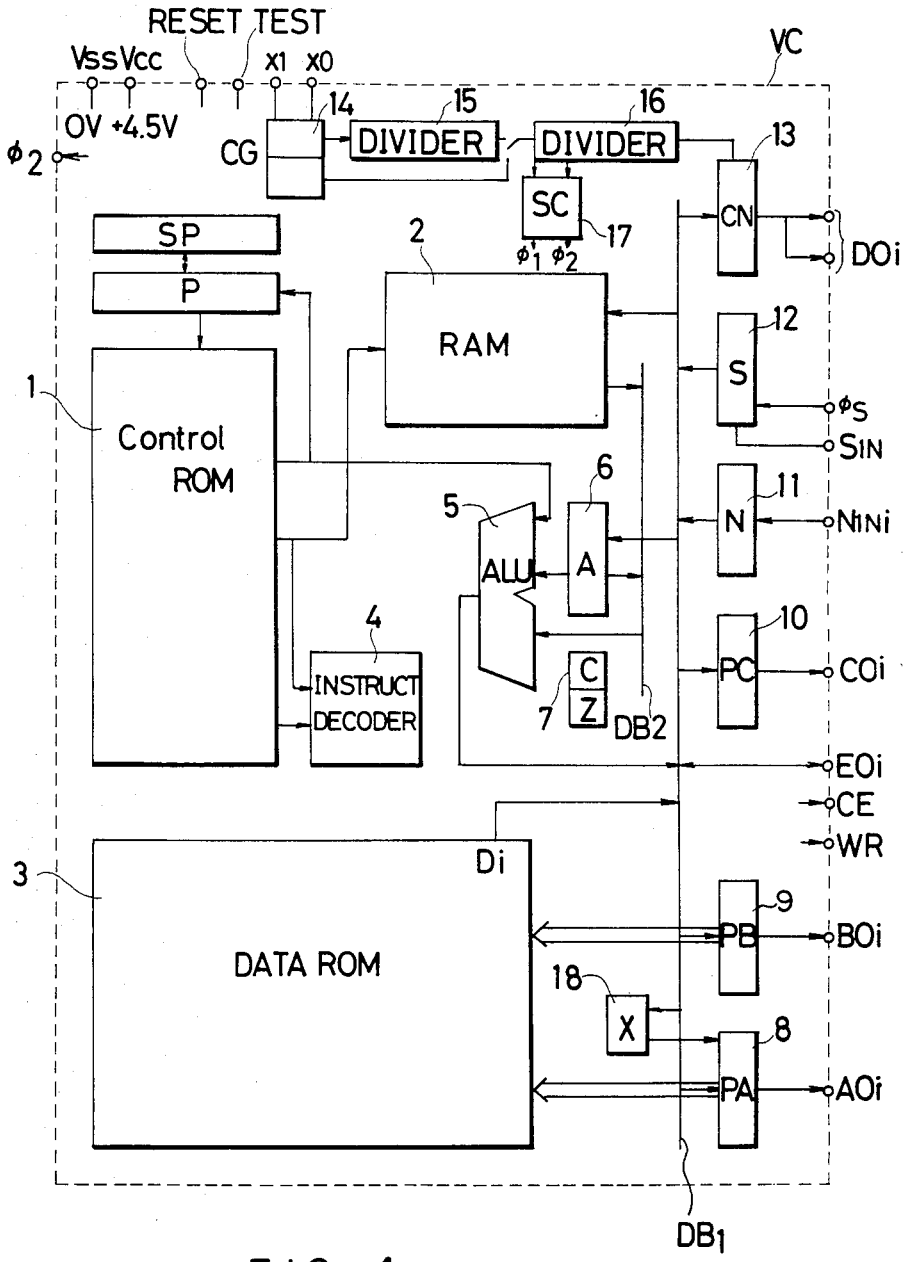
FIG. 4 is a block diagram of showing a one-chip speech synthesizer control in further detail.

FIG. 4 is a block diagram showing the one-chip LSI semiconductor speech synthesizer in further detail. There is illustrated a control memory (control ROM) which contains a train of instructions necessary for synthesis of speech in response to various control signals (for example, the BUSY signal) and data (for example, the word codes) and a train of instructions for an I/O interface, a random access memory (RAM) 2 which serves as a temporary storage or a counter for storing or counting the word codes externally introduced and address information in association with the audio data memory for the purpose of speech synthesis, and the audio data memory (DATA ROM) which stores sound synthesizing data (phonemic data) for synthesis of speech. Although the speech synthesizer is widely applicable depending on the nature of the words previously stored in the audio data memory, it is also possible to expand the length of the audio data memory whenever necessary to increase vocabulary. A program counter specifies a selected one of program steps in the control memory 1 and a stack register SP temporarily stores the contents of the program counter P. An instruction decoder 4 decodes the output of the control memory 1. An arithmetic and logic unit ALU executes arithmetic and logic operations on signals from the control memory 1, signals from an accumulator 6 and signals from the RAM 2. The accumulator 6 temporarily stores the control signals and the data supplied from the respective memories, the arithmetic and logic unit 5 or an external source. A flag 7 (C and Z) is set or reset depending on the results of operations by ALU. A pair of address buffers 8 and 9 (PA and PB) which temporarily hold the address data regarding the audio data meory 3 is connected to the address buses $AO_i$ and $BO_i$. An output buffer IO(PC) temporarily holds desired signals when they are to be delivered to the output port $CO_i$ through execution of the instructions stored in the control memory 1, while an input buffer 11 temporarily holds the control signals or the data received by the input port $N_{INi}$. Another input buffer 12 receives the control signals and the data externally applied thereto. Each time the signal is applied to $\phi_S$, the input buffer 12 accepts the data applied to $S_{IN}$ and shifts the contents of a buffer S. This procedure is repeated S times to place all of the 8-bit data into the buffer S. A family of counters 13 (CN) includes an output buffer for temporarily holding the audio data, a presettable counter and a pulse width modulation (PWM) output counter with its details being more fully understood from a block diagram of FIG. 5 and a time chart of FIG. 6.

Figure 5:
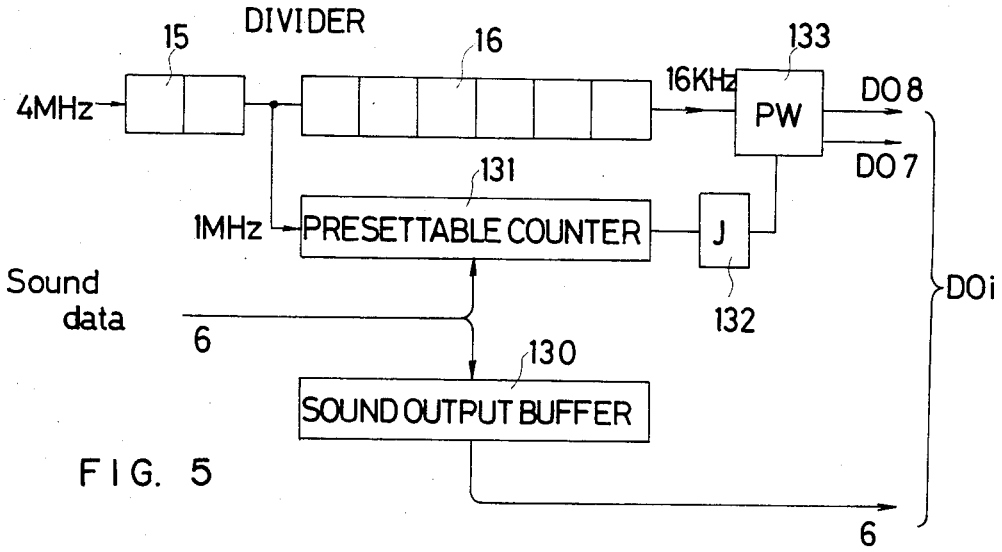
FIG. 5 is a block diagram showing details of a counter in the synthesizer control.
Figure 6:
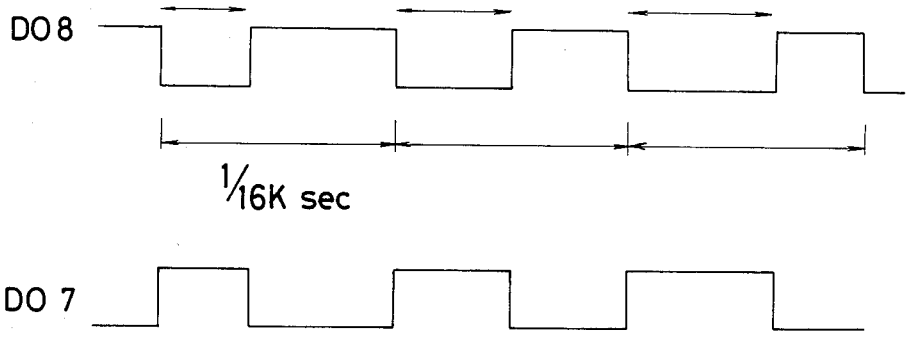
FIG. 6 is a time chart for explanation of operation of the counter of FIG. 6.

In FIG. 5, the audio data are applied to the output buffer 130 and fed to the output port $DO_i$ and to the presettable counter 131. The presettable counter 131 receives the output of a frequency divider 15, decrements its count and, when the count is "zero", provides its output for a pulse width modulation output buffer (PW) 133. The audio data entering the presettable counter 131 is decremented in synchronism with a 1 MHz signal from the divider 15. A "zero" detector 132, when sensing "zero", provides its output signal for the pulse width modulation buffer (PW) 133. FIG. 6 depicts the waveform of the pulse width modulation outputs. Though the interval corresponding to sampling frequency (16 KHz) is fixed, the outputs are modulated in terms of the length of "1's" or "0's" within each of the intervals. These signals are converted into analog signals merely through a lowpass filter. A reference signal generator 14 generates a reference signal and provides quartz oscillation by means of a built-in oscillator. A pair of frequency dividers 15 and 16 supply outputs as timing signals to the counter 13. When the reference signal generator 14 comprises the built-in oscillator, its oscillation output is admitted to the junction of the dividers 15 and 16. A system clock generator 17 also generates system clock pulses $\phi_1$ and $\phi_2$. A 4-bit memory 18 (X) stores the 4-bit contents of the address buffer 8 (PA) of the audio data memory 3 in a semi-fixed manner, for accelerating the addressing of the audio data memory as described below. A data bus $DB_1$ provides a common communication path for the data between the respective buffers, RAM 2, ALU 5 and the audio data memory 3. A second data bus $DB_2$ permits data transmission between the accumulator 6, RAM 2 and ALU 5. $EO_i$ connected to the data bus $DB_1$ is used to supply or receive the data to or from the expansion memory.

Figure 7:
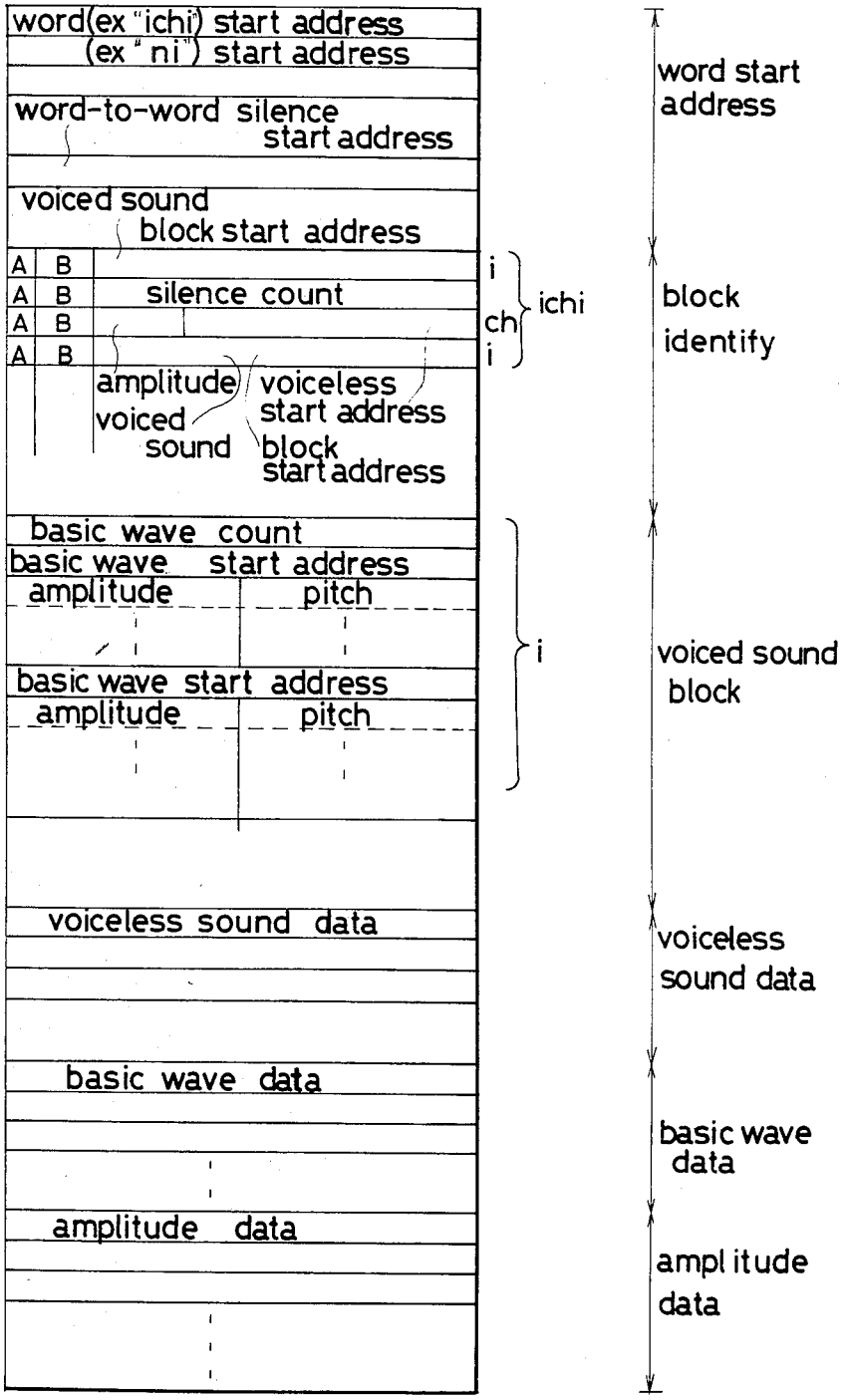
FIG. 7 is a diagram showing the contents of a sound data memory.

FIG. 7 shows the contents of the audio data memory (that is, DATA ROM of FIG. 4). A word start address is stored for each of the word codes to define what address the sequence of speech synthesizing begins to synthesize the corresponding sound. The sequence of speech synthesizing is different from word to word and identifies the basic sound information to use as well as amplitude information, pitch information, and repetition information to use for modifying operation. The basic sound information is a basic unit for speech synthesis and it may be subjected to the modifying operation including the above-mentioned multiplications for the purpose of speech synthesis.

The word codes have a specific relationship with their start address. The control memory (control ROM) evaluates the associated start address according to the word codes fed to RAM and supplies that address information to the address buffers PA and PB. The contents of the audio data memory addressed by the buffers PA and PB, that is, the word start address is fetched to a desired region of RAM. This start address is the leading address of any of the sequences of speech synthesizing and that sequence of speech synthesizing is fetched and fed to RAM in a similar way. Thereafter, pursuant to these fetched sequences of speech synthesizing, a predetermined number of pieces of the basic sound information are combined and subjected to the modifying operation. The result is that audio signals are reproduced and fed to the audio output buffer 18 at the sampling frequency.

As stated earlier, the control memory 1 is 18 bits long (per step) and contains 100 steps of operation and the audio data memory 3 is 8 bits long (per step) and contains several 1000 steps (byte). This distinction as to the bit length of the steps provides increased speed of speech synthesizing.

In other words, the longer the bit length of each the steps in the control memory 1 (CONTROL ROM) the greater the number of proceses which can be effected during each of the steps. It is thus possible to execute more desired operations within a given interval of time without increasing the frequency of the system clocks. On the other hand, for the audio data memory 3 it is unnecessary to elongate the bit length of each step. In other words, each control step is of a bit length enough to store the above-mentioned start address, the sequences of speech synthesizing, the basic sound information. Accordingly, the audio data memory 3 may be of the same bit length as that of the expansion general-purpose memory. This further results in the advantage of addressing and fetching the data from the audio data memory 3 and the external or auxiliary audio data memory in the same manner.

It is clear that the externally expandble memory necessarily should not comprise a ROM and may use a RAM loaded with audio data externally applied and backed up by a battery. Depending the sort of the audio data to be added, any kind of synthesized voices may be successfully reproduced.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A speech synthesizer comprising a one-chip semiconductor integrated circuit which includes:

first memory means for storing information for speech synthesizing;

second memory means for storing control instructions and for addressing said first memory means for speech synthesis using said information stored in said first memory means;

an external connection port for connecting said chip to means for producing audible synthesized speech output; and an external connection port for expansion of the memory capacity of said first memory means;

wherein said second memory means has a one-word length longer than that of said first memory means.

2. A speech synthesizer comprising a one-chip LSI semiconductor circuit which includes:

control memory means for storing sequences for reproducing a plurality of sounds as fixed program instructions;

data memory means for storing sound data including phonemic information for speech synthesis, and instructions data for modifying operations including data selection, pitch selection and repetition number selection; and processor memory means operatively connected to said control memory means and said data memory means for executing temporary storage and arithmetic operations necessary for speech synthesis, wherein said control memory means has a one-word length of 18 bits and said data memory means has a one-word length of 8 bits.

3. A speech synthesizer as in claim 2, wherein said control memory means comprises 100 operation steps and said data memory means comprises in excess of 1000 steps.

* * * * *